US009435351B2

(12) United States Patent
Lin et al.

(10) Patent No.: US 9,435,351 B2
(45) Date of Patent: Sep. 6, 2016

(54) FAN MODULE

(71) Applicants: Inventec (Pudong) Technology Corporation, Shanghai (CN); INVENTEC CORPORATION, Taipei (TW)

(72) Inventors: Yu-Huan Lin, Taipei (TW); Yi-Chun Shih, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 390 days.

(21) Appl. No.: 14/246,954

(22) Filed: Apr. 7, 2014

(65) Prior Publication Data

US 2015/0147166 A1 May 28, 2015

(30) Foreign Application Priority Data

Nov. 25, 2013 (CN) ..... 2013 1 0608698

(51) Int. Cl.

| | |
|---|---|
| ***F04D 29/52*** | (2006.01) |
| ***F04D 25/06*** | (2006.01) |
| ***F04D 19/00*** | (2006.01) |
| ***F04D 29/60*** | (2006.01) |

(52) U.S. Cl.

CPC ..... *F04D 29/522* (2013.01); *F04D 19/002* (2013.01); *F04D 25/0613* (2013.01); *F04D 29/601* (2013.01)

(58) Field of Classification Search

CPC ..... F04D 29/522; F04D 29/601; F04D 25/0613; F04D 19/002

USPC ..... 415/213.1; 454/184; 361/678, 690, 694, 361/695

See application file for complete search history.

(56) References Cited

U.S. PATENT DOCUMENTS

| | | | | |
|---|---|---|---|---|
| 6,040,981 A * | 3/2000 | Schmitt | G06F 1/18 | 312/221 |
| 6,556,437 B1 * | 4/2003 | Hardin | H05K 7/20172 | 361/679.48 |
| 6,951,446 B2 * | 10/2005 | Hung | F04D 25/166 | 361/695 |
| 6,970,353 B2 * | 11/2005 | Brovald | G06F 1/20 | 165/121 |
| 7,450,379 B2 * | 11/2008 | Chen | H05K 7/20172 | 312/236 |

* cited by examiner

*Primary Examiner* — Hoang Nguyen
(74) *Attorney, Agent, or Firm* — Maschoff Brennan

(57) ABSTRACT

A fan module, applied to a server including a first joint portion, includes a fan body, a first metal casing, a second metal casing and a plastic handle. The fan body includes an outlet surface, an inlet surface opposite to the outer surface, a first lateral surface and a second lateral surface. The first and second lateral surfaces are located between the outlet surface and the inlet surface. The first metal casing includes an air-through wall located on the outlet surface or the inlet surface, a first lateral wall connected to the air-through wall and mounted on the first lateral surface, and a metal handle connected to the first lateral wall. The second metal casing includes a second lateral wall mounted on the second lateral surface. The plastic handle, mounted on the second lateral wall, includes a second joint portion, for being engaged with the first joint portion.

10 Claims, 8 Drawing Sheets

FAN MODULE

CROSS-REFERENCE TO RELATED APPLICATIONS

This non-provisional application claims priority under 35 U.S.C. §119(a) on Patent Application No(s). 201310608698.0 filed in China on Nov. 25, 2013, the entire contents of which are hereby incorporated by reference.

BACKGROUND OF THE INVENTION

1. Technical Field of the Invention

The disclosure relates to a fan module, and more particularly to, a fan module applied to a server.

2. Description of the Related Art

With the development of technology, the performance of electronic devices is increased accordingly. However, the improvement of the electronic device brings more heat energy when the electronic device operates, which rises the temperature of the electronic device. When the temperature is too high, the efficiency is lowered or the operation may become abnormal, even failure. In order to solve the problem of high temperature, recently, manufacturers dispose a heat dissipation device for decreasing the temperature of the electronic device.

Take server for example, several central processing units (CPUs) and several fan modules are mounted inside the server, and the fan modules are detachably fastened on a frame of the server and adjacent to a motherboard where the CPUs located. When the server operates, the CPUs generate a large amount of heat, and the fan module takes the heat away from the CPUs. Thus, the temperature of the CPUs decreases such that the server may operate normally. Specifically, the fan module comprises a fan body, two plastic protective plates and two plastic handles. The two plastic protective handles are mounted on an inlet surface and an outlet surface of the fan body, respectively. The two plastic handles are mounted on two opposite sides of the fan body. When the fan module is dissembled from the server, users may apply a force to grip the two plastic handles such that the fan module may be detached from the server.

However, the plastic handle is elastic. Users are hard to apply a force to the plastic handle so the fan module may not be stably dissembled from the server.

Moreover, the two plastic protective plates and the two plastic handles need to assembled on the fan body in sequence, which is a time-consuming process.

SUMMARY OF THE INVENTION

According to one embodiment, a fan module is applied to a server including a first joint portion. The fan module comprises a fan body, a first metal casing, a second metal casing and a plastic handle. The fan body includes an outlet surface, an inlet surface, a first lateral surface and a second lateral surface. The first lateral surface and the second lateral surface are opposite to each other, and the first lateral surface and the second lateral surface are opposite to each other and both located between the outlet surface and the inlet surface. The first metal casing comprises an air-through wall, a first lateral wall and a metal handle. The first lateral wall is connected to a side of the air-through wall. The metal handle is connected to the first lateral wall. The air-through wall is located on the outlet surface or the inlet surface, and the first lateral wall is mounted on the first lateral surface. The second metal casing comprises a second lateral wall mounted on the second lateral surface. The plastic handle, mounted on the second lateral wall, includes a second joint portion, for being engaged with the first joint portion.

According to another embodiment, a fan module is applied to a server including a first joint portion. The fan module comprises a fan body, a first metal casing, a second metal casing and a plastic handle. The fan body includes an outlet surface, an inlet surface, a first lateral surface and a second lateral surface. The outlet surface and the inlet surface are opposite to each other. The first lateral surface and the second lateral surface are opposite to each other and both located between the outlet surface and the inlet surface. The first metal casing comprises an air-through wall, a first lateral wall and a metal handle. The first lateral wall is connected to a side of the air-through wall. The metal handle is connected to the first lateral wall. The air-through wall is mounted on the outlet surface or the inlet surface. The first lateral wall is mounted on the first lateral surface. The second metal casing comprises a ventilation wall and a second lateral wall. The second lateral wall is connected to a side of the ventilation wall. The ventilation wall is mounted on the inlet surface or the outlet surface such that the ventilation wall and the air-through wall are located between two opposite side of the fan body. The second lateral wall is mounted on the second lateral surface. The plastic handle, mounted on the second lateral wall, includes a second joint portion for being engaged with the first joint portion.

BRIEF DESCRIPTION OF THE DRAWINGS

The present disclosure will become more fully understood from the detailed description given hereinbelow, along with the accompanying drawings which are for illustration only, thus are not limitative of the present disclosure, and wherein.

DETAILED DESCRIPTION

Figure 1:
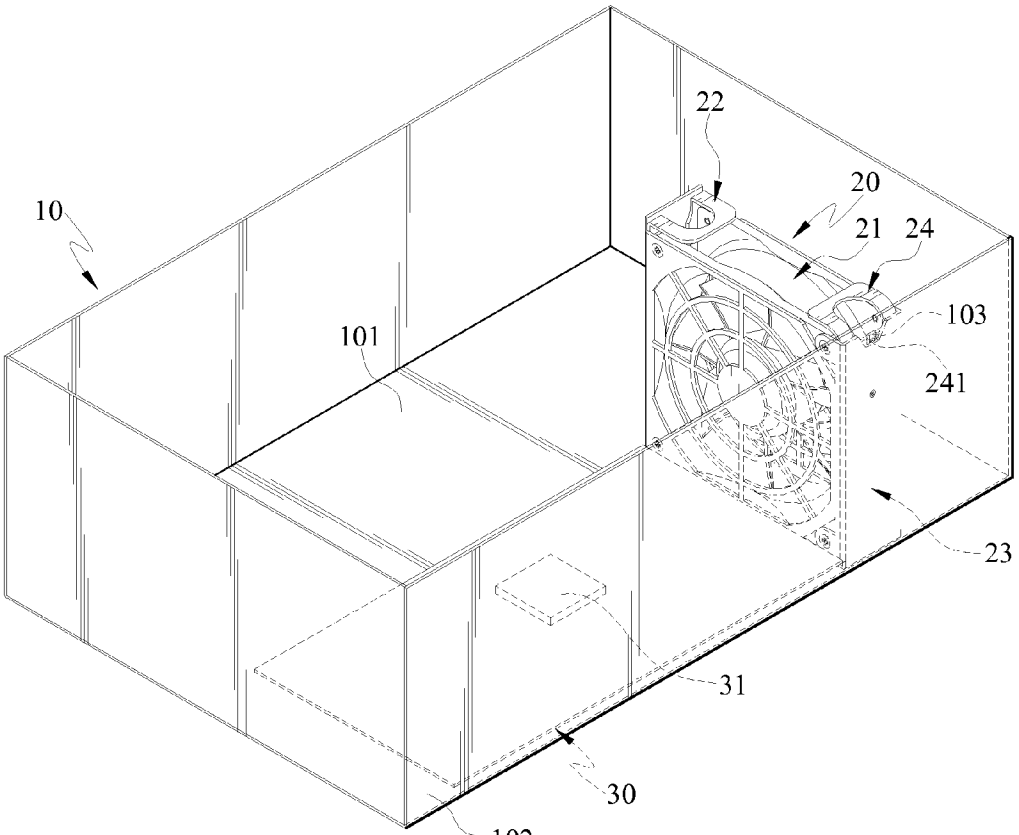
FIG. 1 is a perspective view of a server system according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In this disclosure, the wordings "on", "below", "left", "right", "top", "bottom" and "side" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "bottom" side of other elements would then be oriented on "top" sides of the other elements. The exemplary term "bottom", can therefore, encompasses both an orientation of "bottom" and "top," depending of the particular orientation of the figure. Similarly, if the device in one of the figures is turned over, elements described as "below" or "under" other elements would then be oriented "above" or "on" the other elements. The exemplary terms "below" or "beneath" can, therefore, encompass both an orientation of above and below.

An embodiment of the disclosure provides a fan module applied to a server. The fan module may be detachably mounted inside the server, for performing heat dissipation on a heating component inside the server.

Figure 2:
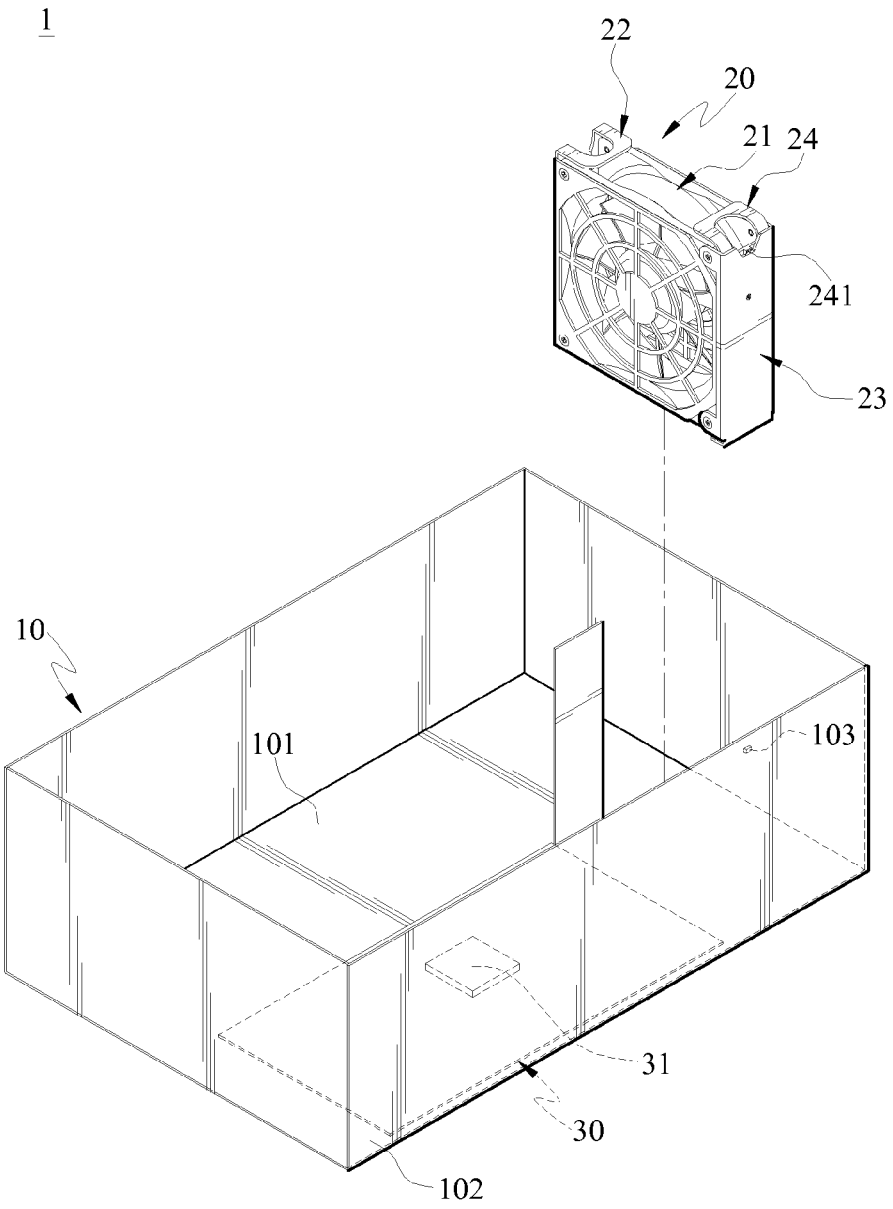
FIG. 2 is an exploded view of the server system according to the embodiment of the disclosure.

Please refer to FIGS. 1 and 2, FIG. 1 is a perspective view of a server system according to an embodiment of the disclosure, and FIG. 2 is an exploded view of the server system according to the embodiment of the disclosure. In this embodiment of the disclosure, the server system 1 comprises a server 10, a motherboard 30 and a fan module 20. The motherboard 30 and the fan module 20 are mounted inside the server 10, and the fan module 20 is located adjacent to the motherboard 30.

In this embodiment, the server 10 comprises a bottom wall 101, a side wall 102 and a first joint portion 103. The bottom wall 101 and the side wall 102 are connected with each other. The motherboard 30 is securely mounted on the bottom wall 101, and the first joint portion 103 is mounted on the side wall 102. The fan module 20 is detachably mounted inside the server 10 by the first joint portion 103. In this embodiment, the first joint portion 103 is a protrusion, but the disclosure is not limited thereto. Moreover, the motherboard 30 comprises a heating component. In this embodiment, the heating component is a CPU 31, but the disclosure is not limited thereto. In other embodiments, the heating component is a processing chip or a hard ware drive. In this embodiment, when the server system 1 operates, the CPU 31 operates and produces heat accordingly. The fan module 20 operates for driving an air current to take away the heat from the CPU 31. Therefore, the fan module 20 performs heat dissipation on the CPU 31 to reduce the temperature, thereby maintaining the normal operation of the CPU 31.

Figure 3:
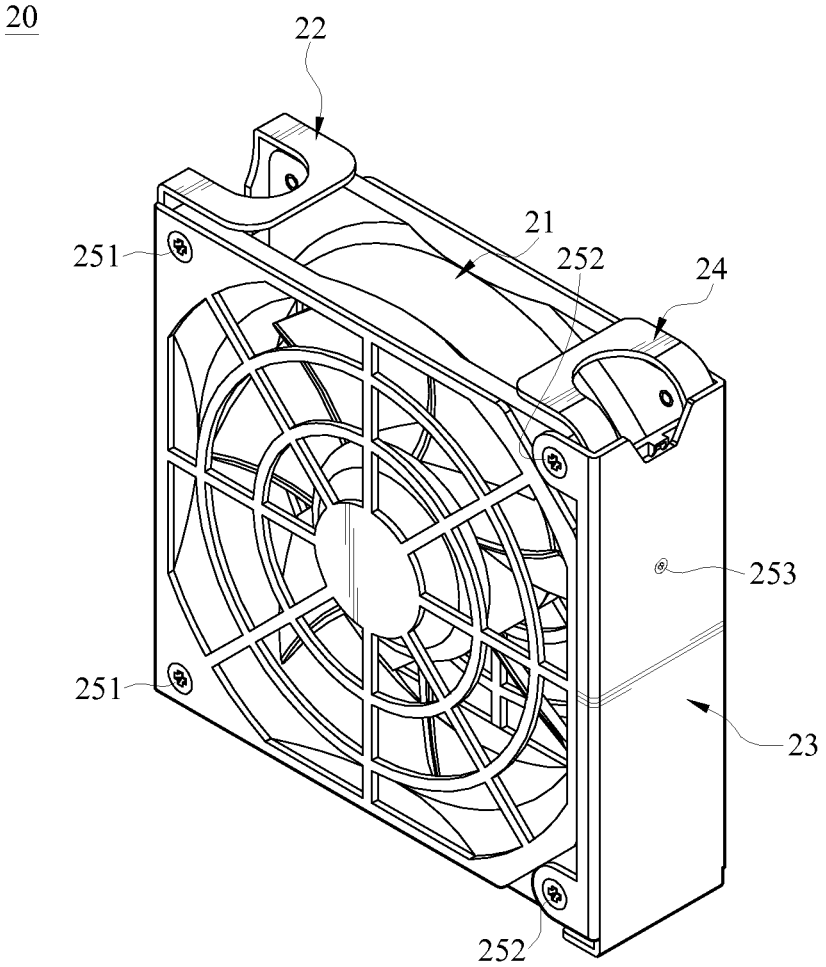
FIG. 3 is a perspective view of a fan module according to the embodiment of the disclosure.
Figure 4:
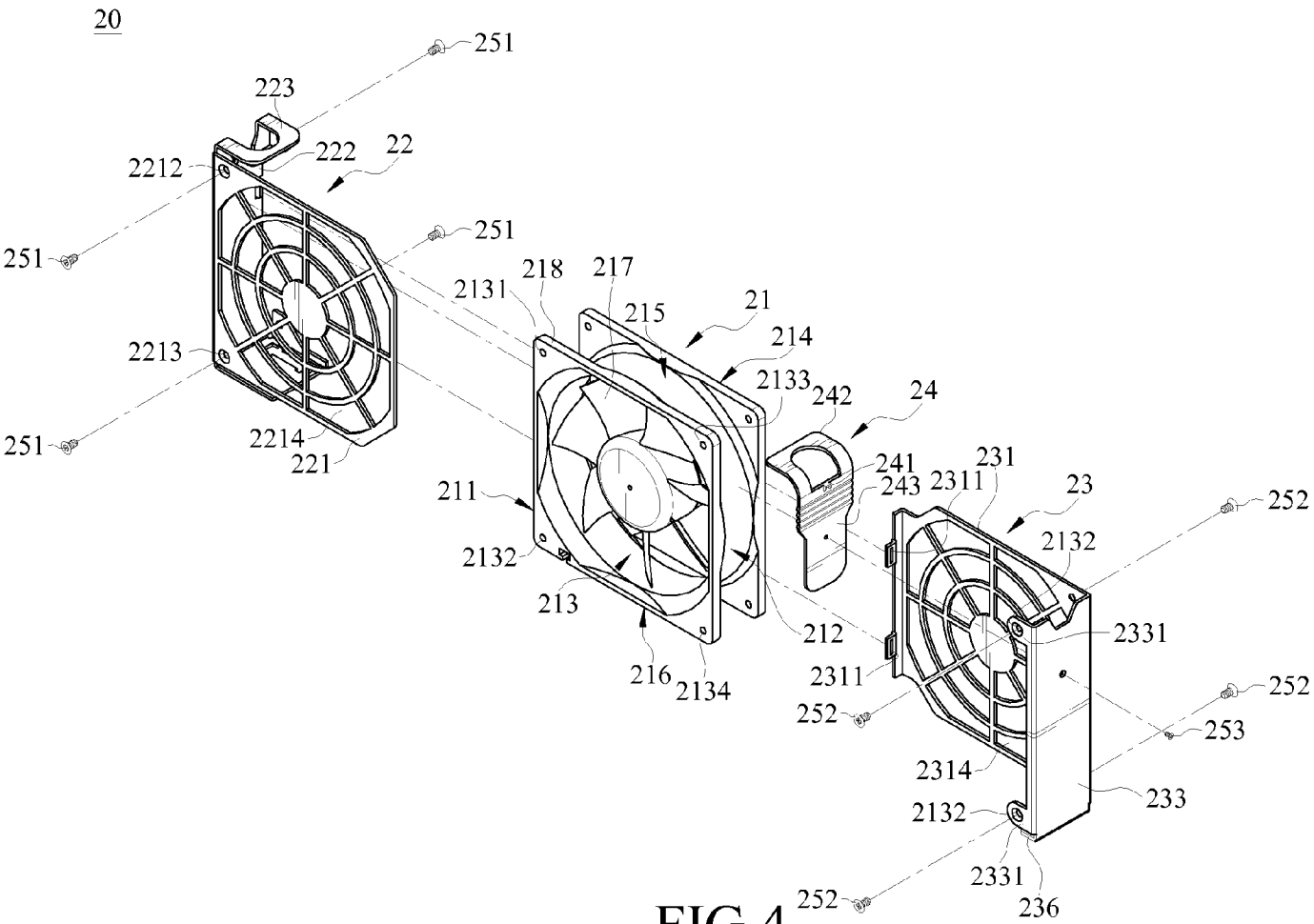
FIG. 4 is an exploded view of the fan module according to the embodiment of the disclosure.
Figure 5:
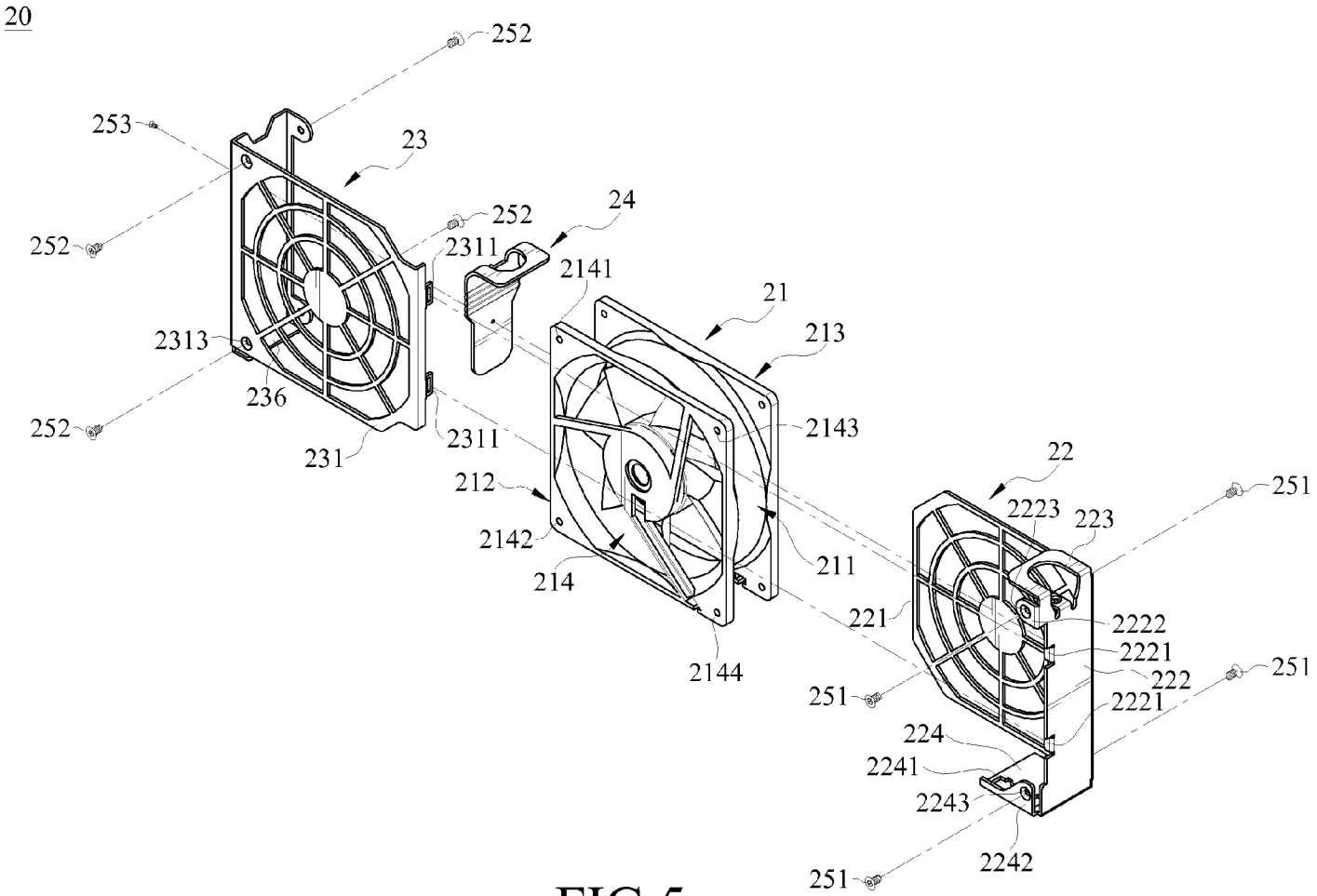
FIG. 5 is another exploded view of the fan module according to the embodiment of the disclosure.

The following describes the detailed structure of the fan module 20, please refer to FIGS. 2 to 5. FIG. 3 is a perspective view of a fan module according to the embodiment of the disclosure, FIG. 4 is an exploded view of the fan module according to the embodiment of the disclosure, and FIG. 5 is another exploded view of the fan module according to the embodiment of the disclosure. In this embodiment, the fan module 20 comprises a fan body 21, a first metal casing 22, a second metal casing 23 and a plastic handle 24. The first metal casing 22 and the second metal casing 23 are both mounted on the fan body 21 for surrounding the fan body 21 together. The plastic handle 24 is securely mounted on the second metal casing 23, and the plastic handle 24 extends towards outside (i.e., upward in the figures) from the fan body 21.

The following describes the detailed structure of the fan body 21 of the fan module 20. In this embodiment, the fan body 21 comprises a blade assembly 217 and a framework 218. The blade assembly 217 is located inside the framework 218, and two opposite sides of the blade assembly 217 both expose from the framework 218. Furthermore, the fan body 21 includes an inlet surface 213, an outlet surface 214, a first lateral surface 211, a second lateral surface 212, a top surface 215 and a bottom surface 216. Specifically, the inlet surface 213 and the outlet surface 214 are opposite to each other and located at two sides of the fan body 21, respectively. The first lateral surface 211 and the second lateral surface 212 also are opposite to each other and both located between the outlet surface 214 and inlet surface 213. The top surface 215 and the bottom surface 216 are both opposite to each other and both located between the outlet surface 214 and the inlet surface 213. Nevertheless, the framework 218 includes eight openings 2131, 2132, 2133, 2134, 2141, 2142, 2143 and 2144. The four openings 2131, 2132, 2133 and 2134 are located at four corners of the inlet surface 213, respectively. The other four openings 2141, 2142, 2143 and 2144 are located at four corners of the outlet surface 214, respectively, but the number and the positions of the openings do not limit the disclosure.

The following describes the detailed structure of the first metal casing 22 of the fan module 20. In this embodiment, the first metal casing 22 comprises an air-through wall 221, a first lateral wall 222, a metal handle 223 and an extended wall 224. The first lateral wall 222 is connected to one side of the air-through wall 221. The metal handle 223 is connected to one end of the first lateral wall 222, and the extended wall 224 is connected to the opposite end of the first lateral wall 222 and near the air-through wall 221. Also, the extended wall 224 corresponds to the bottom surface 216. Additionally, the air-through wall 221 is mounted on the inlet surface 213 of the fan body 21, and the first lateral wall 222 is mounted on the first lateral surface 211 of the fan body 21. However, the positions where the above-mentioned air-through wall 221 and the first lateral wall 222 correspond to the fan body 21 do not limit the disclosure. In other embodiments, the air-through wall 221 is mounted on the outlet surface 214 of the fan body 21, and the first lateral wall 222 is mounted on the second lateral surface 212 of the fan body 21.

Moreover, in this embodiment, the air-through wall 221 includes a plurality of vents 2214 and two first through holes 2212 and 2213. When the fan module 20 operates, an air current may enter or exit from the main body 21 via the vents 2214 of the air-through wall 221. One of the two fasteners 251 penetrates the first through hole 2212 and the opening 2131 to be affixed to each other, and the other fastener 251 penetrates the first through hole 2213 and the opening 2132 in sequence to be affixed to each other. Furthermore, the first lateral wall 222 further comprises a fastening section 2222 which corresponds to and faces the outlet surface 214. The fastening section 2222 further includes a first through hole 2223. One fastener 251 penetrates the first through hole 2223 and the opening 2143 in sequence to be affixed to each other. In this embodiment, the extended wall 224 includes a cable hole 2241 and a first fastening section 2242. The first fastening section 2242 corresponds to and faces the outlet surface 214 as well as including a first through hole 2243. A cable wire (not shown) is connected to the fan body 21 from the motherboard 30 via the cable hole 2241, for providing signals and power for the fan body 21 to make the fan body 21 operate. Another fastener 251 penetrates the first through hole 2243 and the opening 2144 to be affixed to each other. Moreover, the metal handle 223 extends towards outside from the first lateral wall 222 and is located on the top surface 215 of the fan body 21. In this embodiment, the air-through wall 221, the first lateral wall 222, the metal handle 223 and the extended wall 224 are integrally formed by a single piece of a metal sheet.

The following describes the detailed structure of the second metal casing 23 of the fan module 20. In this embodiment, the second metal casing 23 comprises a ventilation wall 231, a second lateral wall 233 and an extended wall 236. The second lateral wall 233 is connected to one side of the ventilation wall 231. The ventilation wall 231 is located on the outlet surface 214, so the ventilation wall 231 and the air-through wall 221 are located on the two opposite sides of the fan body 21 (i.e., the inlet surface 213 and the outlet surface 214). In this embodiment, the second lateral wall 233 is located on the second lateral surface 212, and the extended wall 236 is located on and corresponds to the bottom surface 216. In other embodiments, the ventilation wall 231 is located on the inlet surface 213, and the second lateral wall 233 is located on the first lateral surface 211. In this embodiment, the ventilation wall 231, the second lateral wall 233 and the extended wall 236 are integrally formed by a single piece of a metal sheet.

In this embodiment, moreover, the ventilation wall 231 includes a plurality of vents 2314 and two second through holes 2312, 2313. When the fan module 20 operates, the air current may enter or exit from the fan body 21 via the vents 2314 of the ventilation wall 231. One fastener 252 penetrates the second through hole 2312 and the opening 2141 to be affixed to each other, and another fastener 252 penetrates the second through hole 2313 and the opening 2142 to be affixed to each other. Additionally, the second lateral wall 233 further comprises two fastening sections 2331 corresponding to and facing the inlet surface 213. Each of the two fastening sections 2331 further includes a second through hole 2332. Another one fastener 252 penetrates the second through holes 2332 and the opening 2133 to be affixed to each other, and yet another one fastener 252 penetrates the other second through hole 2332 and the opening 2134 to be affixed to each other.

The following describes the plastic handle 24 of the fan module 20 according to this embodiment. The plastic handle 24 is mounted on the second lateral wall 233 of the second metal casing 23 by a fastener 253. The plastic handle 24 is located between the fan body 21 and the first metal casing 22, and the plastic handle 24 extends towards outside (upward in the figures) from the top surface 215 of the fan body 21. The metal handle 223 and the plastic handle 24 are located on two opposite sides of the top surface 215. Specifically, the plastic handle 24 includes a second joint portion 241, for being affixed to and limited by the first joint portion 103 of the server 10. In this embodiment, the second joint portion 241 is a protrusion, but the disclosure is not limited thereto. Thus, when users try to dispose the fan module 20 in the server 10, only the second joint portion 241 of the plastic handle 24 needs to be affixed to the first joint portion 103 of the server 10. Then, the assembly and the positioning are finished. When the users try to dissemble the fan module 20 from the server 10, the users apply an external force to both the plastic handle 24 and the metal handle 223, the plastic handle 24 is elastically deformed and moved towards the metal handle 223 such that the second joint portion 241 of the plastic handle 24 is detached from the first joint portion 103 of the server 10. Thus, the fan module 20 is dissembled from the server 10. Thanks to the stiffness of the metal handle 223 and the elasticity of the plastic handle 24 of the fan module 20, when the users apply a force, only the plastic handle 24 is elastically deformed so as to be detached from the server 10. Nevertheless, the stiffness of the metal handle 223 provides better supporting effect for the users to easily apply the external force to the plastic handle 24.

In this embodiment, the first metal casing 22 and the second metal casing 23 is combined together according to a combination manner. In detail, the first lateral wall 222 of the first metal casing 22 comprises two first connection portions 2221, the ventilation wall 231 of the second metal casing 23 comprises two second connection portions 2311, and the first connection portions 2221 are adapted for detachably for being mounted on the second connection portions 2311, respectively. In this embodiment, the first connection portion 2221 is a hook, the second connection portion 2311 is an eye, but the positions and the types of the first connection portion 2211 and the second connection portion 2311 do not limit the disclosure. In some other embodiments, the air-through wall 221 of the first metal casing 22 comprises two first connection portions 2221, and the second lateral wall 233 of the second metal casing 23 comprises a second connection portion 2311. In some other embodiments, the first connection portion 2221 is an eye, and the second connection portion 2311 is a hook. Thus, the first metal casing 22 and the second metal casing 23 are attached to (i.e., being assembled together) or detached from each other by the combination of the first connection portion 2221 and the second connection portion 2311. To sum up, the embodiments of the disclosure provides the combination of the first metal casing 22 and the second metal casing 23 that are easily attached to and detached from each other. However, the combination manner of the first metal casing 22 and the second metal casing 23 are not the necessary elements in this disclosure and do not limit the disclosure. In some other embodiments, the first metal casing 22 do not include the first connection portion 2221, and the second metal casing 23 do not include the second connection portion 2311, either.

Figure 6:
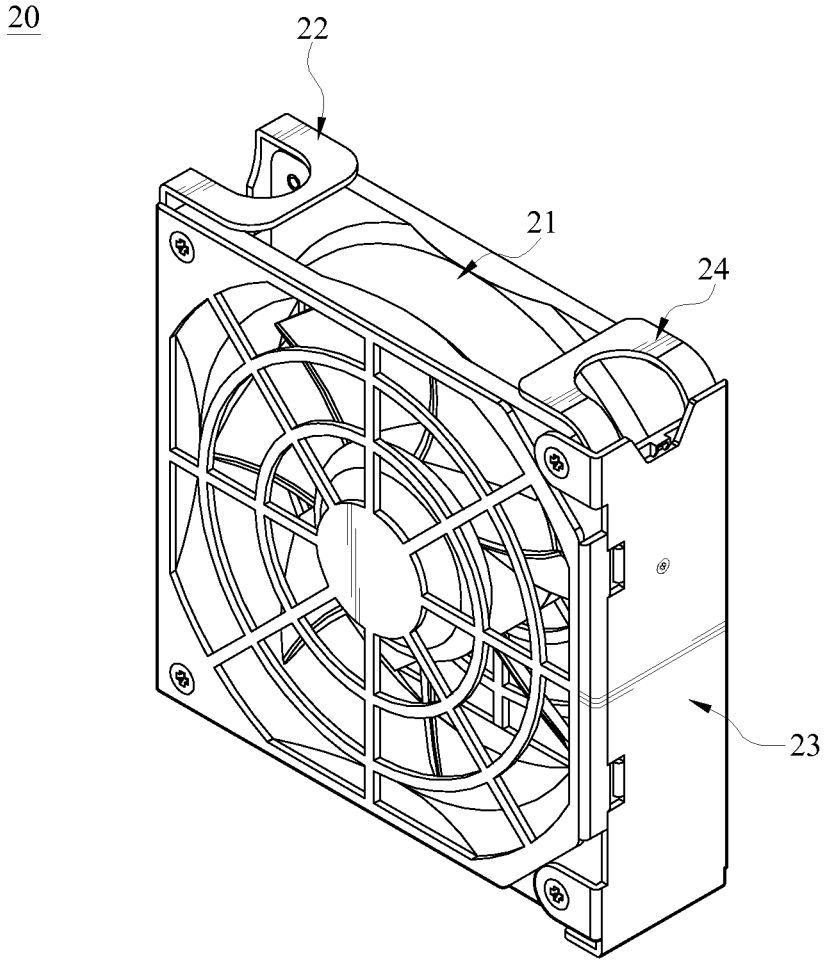
FIG. 6 is a perspective view of a fan module according to another embodiment of the disclosure.
Figure 7:
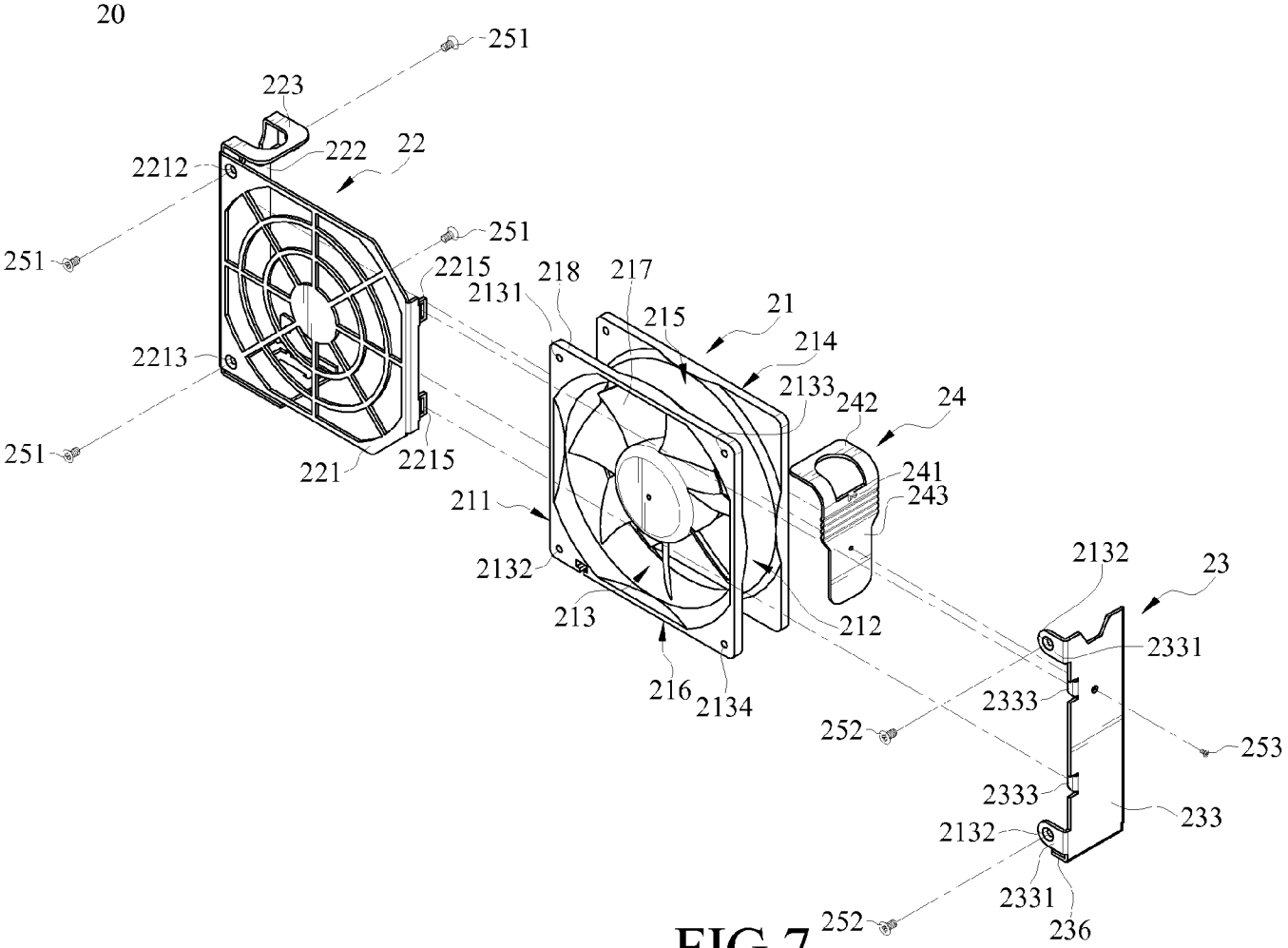
FIG. 7 is an exploded view of the fan module according to another embodiment of the disclosure.
Figure 8:
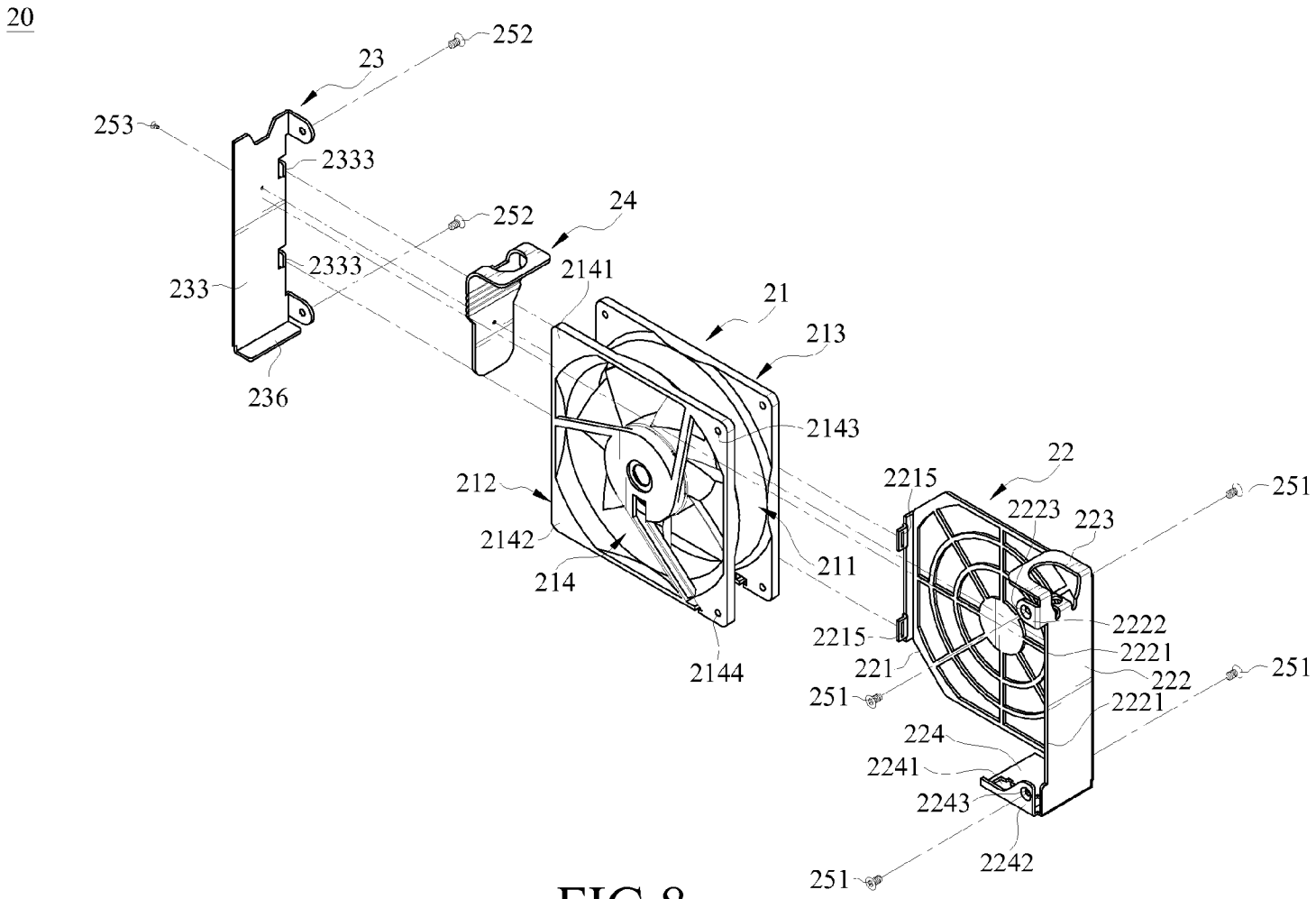
FIG. 8 is another exploded view of the fan module according to another embodiment of the disclosure.

The following describes another fan module according to another embodiment of the disclosure. Please refer to FIG. 6 is a perspective view of a fan module according to another embodiment of the disclosure, FIG. 7 is an exploded view of the fan module according to another embodiment of the disclosure, and FIG. 8 is another exploded view of the fan module according to another embodiment of the disclosure. The configuration of this embodiment is similar to that of the above-mentioned embodiment, so the same numerals represent similar structures, and hereinbelow, the repeated is not described again. In this embodiment, the second metal casing 23 comprises a second lateral wall 233 and an extended wall 236. It should be noted that the second metal casing 23 do not comprise the ventilation wall 231 disclosed in the above-mentioned embodiment. In other words, the outlet surface 214 of the fan module 20 directly expose and is not protected from the first metal casing 22 and the second metal casing 23. Moreover, in this embodiment, the air-through wall 221 of the first metal casing 22 comprises a first connection portion 2215, the second lateral wall 233 of the second metal casing 23 comprises a second connection portion 2333, and the first connection portion 2215 is detachably mounted on the second connection portion 2333. In this embodiment, the first connection portion 2215 is an eye, the second connection portion 2333 is a hook, but the disclosure is not limited thereto.

To sum up, in the fan module according to the disclosure, the first metal casing comprises the metal handle, and the plastic handle is mounted on the second metal casing. When users try to detach the fan module, they may apply an external force to the metal handle of the first metal casing and the plastic handle mounted on the second metal casing. The plastic handle is elastically deformed to be detached from the server. Because the metal handle has certain stiffness, when users apply the force, the metal handle still maintains its original shape. Therefore, the fan module comprises only one plastic handle for being elastically deformed, which enhances the stability of assembly and disassembly. Moreover, the first metal casing and the second metal casing surround and support the fan module together, and the first metal casing and the second metal casing may be attached to and detached from each other, thereby reducing cost and manufacturing time. Furthermore, the fan module of this disclosure does not need to dispose another casing for protection, which reducing material costs, too.

What is claimed is:

1. A fan module, applied to a server including a first joint portion, the fan module comprising:

a fan body including an outlet surface, an inlet surface, a first lateral surface and a second lateral surface, wherein the first lateral surface and the second lateral surface are opposite to each other, and the first lateral surface and the second lateral surface are opposite to each other and both located between the outlet surface and the inlet surface;

a first metal casing comprising an air-through wall, a first lateral wall and a metal handle, the first lateral wall being connected to a side of the air-through wall, the metal handle being connected to the first lateral wall, the air-through wall being located on the outlet surface or the inlet surface, and the first lateral wall being mounted on the first lateral surface;

a second metal casing comprising a second lateral wall mounted on the second lateral surface; and a plastic handle mounted on the second lateral wall, and the plastic handle including a second joint portion, for being engaged with the first joint portion.

2. The fan module according to claim 1, wherein the air-through wall of the first metal casing comprises a first connection portion, the second lateral wall of the second metal casing comprises second connection portion, and the first connection portion is detachably mounted on the second connection portion.

3. The fan module according to claim 1, further comprising a fastener, the first metal casing including a first through hole, the fan body including an opening, the first through hole facing the opening, and the fastener penetrating the first through hole and the opening to be affixed to each other.

4. The fan module according to claim 1, wherein the plastic handle is located between the fan body and the first metal casing, and the plastic handle extends outside from the fan body.

5. The fan module according to claim 1, wherein the first metal casing further comprises an extended wall connected another side of the first lateral wall, and the extended wall is mounted on a bottom surface of the fan body.

6. A fan module, applied to a server including a first joint portion, the fan module comprising:

a fan body including an outlet surface, an inlet surface, a first lateral surface and a second lateral surface, wherein the outlet surface and the inlet surface are opposite to each other, and the first lateral surface and the second lateral surface are opposite to each other and both located between the outlet surface and the inlet surface;

a first metal casing comprising an air-through wall, a first lateral wall and a metal handle, the first lateral wall being connected to a side of the air-through wall, the metal handle being connected to the first lateral wall, the air-through wall being mounted on the outlet surface or the inlet surface, the first lateral wall being mounted on the first lateral surface;

a second metal casing comprising a ventilation wall and a second lateral wall, the second lateral wall being connected to a side of the ventilation wall, the ventilation wall being mounted on the inlet surface or the outlet surface such that the ventilation wall and the air-through wall are located between two opposite side of the fan body, and wherein the second lateral wall is mounted on the second lateral surface; and a plastic handle mounted on the second lateral wall and including a second joint portion for being engaged with the first joint portion.

7. The fan module according to claim 6, wherein the first metal casing comprises a first connection portion, the second metal casing comprises a second connection portion, and the first connection portion is detachably mounted on the second connection portion.

8. The fan module according to claim 6, further comprising two fasteners, the first metal casing including a first through hole, the second metal casing including a second through hole, the fan body including two openings located on the outlet surface and the inlet surface, respectively, wherein the first through hole and the second through hole face the two openings, respectively, one of the two fasteners penetrates the first through hole and one of the openings to be affixed to each other, and the other fastener penetrates the second through hole and the other opening to be affixed to each other.

9. The fan module according to claim 6, wherein the first metal casing further comprises an extended wall connected to another side of the first lateral wall, the fan body includes a bottom surface connected to the outlet surface, the inlet surface and the first lateral surface, and the extended wall is mounted on the bottom surface.

10. The fan module according to claim 9, wherein the extended wall of the first metal casing includes a cable hole.

* * * * *